US009978382B2

(12) United States Patent
Megías Jiménez

(10) Patent No.: US 9,978,382 B2
(45) Date of Patent: May 22, 2018

(54) METHOD AND APPARATUS FOR EMBEDDING AND EXTRACTING WATERMARK DATA IN AN AUDIO SIGNAL

(71) Applicant: Fundacio per a la Universitat Oberta de Catalunya, Barcelona (ES)

(72) Inventor: David Megías Jiménez, Barcelona (ES)

(73) Assignee: Fundacio per a la Universitat Oberta de Catalunya, Barcelona (ES)

( * ) Notice: Subject to any disclaimer, the term of this patent is extended or adjusted under 35 U.S.C. 154(b) by 0 days. days.

(21) Appl. No.: 15/039,666

(22) PCT Filed: Nov. 28, 2013

(86) PCT No.: PCT/EP2013/074971
§ 371 (c)(1),
(2) Date: May 26, 2016

(87) PCT Pub. No.: WO2015/078502
PCT Pub. Date: Jun. 4, 2015

(65) Prior Publication Data
US 2017/0148451 A1 May 25, 2017

(51) Int. Cl.
*G10L 21/00* (2013.01)
*G10L 19/018* (2013.01)
*G10L 19/16* (2013.01)
*G10L 19/02* (2013.01)

(52) U.S. Cl.
CPC ..... *G10L 19/018* (2013.01); *G10L 19/167* (2013.01); *G10L 19/0212* (2013.01)

(58) Field of Classification Search
CPC ..... G10L 19/018
USPC ..... 704/205
See application file for complete search history.

(56) References Cited

U.S. PATENT DOCUMENTS

2004/0169581 A1* 9/2004 Petrovic ..... G10L 19/018 340/5.2
2008/0270801 A1* 10/2008 Levy ..... G06T 1/0028 713/179
2011/0214143 A1 9/2011 Rits et al.
2015/0340045 A1* 11/2015 Hardwick ..... G10L 19/018 704/205

FOREIGN PATENT DOCUMENTS

EP 2487680 8/2012

OTHER PUBLICATIONS

Fallahpour, et al., 2012 Int. J. Innovative Computing, Information and Control.*

(Continued)

*Primary Examiner* — Forrest F Tzeng
(74) *Attorney, Agent, or Firm* — Klarquist Sparkman, LLP

(57) ABSTRACT

Methods and apparatus for audio watermarking are disclosed in which watermark data is codified in a plurality of Fourier transform coefficients of the audio signal. The watermarked audio is transmitted and captured as sound waves after analogic conversion, typically through a medium with some degree of signal degradation. The receiving end converts the watermarked audio back to the digital domain before extracting the watermark data from the Fourier transform coefficients. This configuration is enhanced in certain embodiments by a robust bit codification technique with fast decoding algorithms, synchronization signalling and error correction.

20 Claims, 3 Drawing Sheets

(56) References Cited

OTHER PUBLICATIONS

Zhao, et al., 2011 Int. Conf. Computational and Information Sciences.*
Fallahpour and Megias, IFIP International Federation for Information Processing 2011.*
Bender, W. et al., "Techniques for data hiding," *IMB Systems Journal*, vol. 35, Nos. 3 and 4, pp. 313-336 (Jan. 1996).
Fallahpour, M. et al., "High capacity robust audio watermarking scheme based on FFT and linear regression," *International Journal on Innovative Computing Information and Control*, pp. 2477-2489 (Apr. 2012).
International Search Report for PCT/EP2013/074971 (dated May 27, 2014).
Kim, H. et al., "Chapter 8—Audio Watermarking Techniques," *Intelligent Watermarking Techniques, World Scientific Singapore*, pp. 185-217 (Jan. 2004).
Zhao, Y. et al., "A Robust Audio Sonic Watermarking Algorithm Oriented Air Channel," *2011 International Conference on Computational and Information Sciences*, pp. 53-57 (Oct. 2011).

* cited by examiner

METHOD AND APPARATUS FOR EMBEDDING AND EXTRACTING WATERMARK DATA IN AN AUDIO SIGNAL

CROSS REFERENCE TO RELATED APPLICATIONS

This is the U.S. National Stage of International Application No. PCT/EP2013/074971, filed Nov. 28, 2013, which was published in English under PCT Article 21(2). The application is incorporated herein in its entirety.

FIELD OF THE INVENTION

The present invention has its application within the telecommunications sector and, particularly, in the area engaged in embedding and extracting data in audio signals.

BACKGROUND OF THE INVENTION—RELATED ART

Digital watermarking consists of embedding hidden data (known as watermark) in a digital object such as audio, video, images and text. This technique allows transmitting supplementary content-related information in a manner that is imperceptible to the user of the digital object, and can be applied to a wide variety of applications, such as broadcast monitoring, owner identification, proof of ownership, transaction tracking, content authentication (with or without tampering localization), copy control, device control and legacy enhancement.

In order to implement a digital watermarking method, both an embedding system and an extraction system are required. The embedding system is implemented in the transmitting end, and uses the digital content and the watermark as inputs in order to generate the watermarked content, that is, a modified digital file with the watermark embedded in it. The extraction system is implemented in the receiving in end, and is responsible for receiving the watermarked content and extracting the embedded watermark. A common watermark key may be used by both ends in order to protect the watermark. Additionally, encryption and encryption keys can be used for increasing the security of the embedded watermark.

In the particular case of audio watermarking, the watermark data is embedded in the audio content of an audio or video digital file, using either the time or the frequency domains for data embedding. In frequency domain audio watermarking, an original audio signal undergoes a frequency transform such as a Discrete Fourier Transform (DFT), Modified Discrete Cosine Transform (MDCT) or Wavelet Transform (WT). The bits from the watermark are embedded by replacing a plurality of the resulting transform coefficients with modified coefficients which codify said bits. One of the alternatives for frequency domain audio watermarking is to codify the watermark in the coefficients of a Fast Fourier Transform (FFT), as shown in "High capacity FFT-based audio watermarking" (M. Fallahpour and D. Megias, Eds. B. de Decker et al., Communications and Multimedia Security, Lecture Notes in computer Science Volume 7025, pages 235-237, 2011). This approach takes advantage of the translation-invariant property of FFT coefficients to resist small distortions in the time domain. It therefore provides a high degree of robustness against common signal processing such as noise, filtering and compression, while also enabling a high capacity with no great perceptual distortion. However, these techniques are aimed towards all-digital systems in which the watermarked audio is digitally transmitted to the receiving end through a communication network without large distortions. The watermark cannot therefore be transmitted to a nearby device which is in proximity of a source playing the watermarked audio content, but does not have access to the original watermarked audio digital file. In this scenario, the spectrum of the watermarked audio may be distorted and shifted, hindering the decoding of the embedded data. Furthermore, as the receiving end is not notified of the start of a particular file within a continuous audio transmission, a conventional watermark extraction system is not capable of determining when a watermark is being transmitted.

The aforementioned limitations are also present, for example, in the following systems known in the state of the art. US 2012/300971 A1 discloses a system in which the watermark is segmented and embedded into multiple channels of audio and video. WO 2013/0179666 A1 provides an approach which minimizes distortion to the listener by only embedding data in some particular sections of the audio signal. US 2004/0257977 A1 also aims to minimize distortion to the listener by embedding watermark data in selected positions of an audio signal. In the proximity of the selected positions, data embedding is performed by means of multiplying the discrete Fourier Transform coefficients of the audio signal with values encoding the watermark data. EP 2562749 discloses a system which sorts the audio file into blocks or sections according to whether they are susceptible of being watermarked. Nevertheless, all these watermark extraction systems operate directly on the digital audio signal after being transmitted through a digital communication network without major distortions, and hence cannot be applied to a scenario in which a watermarked audio file is transmitted through sound waves.

All approaches known in the state of the art therefore fail to provide a robust an efficient audio watermarking solution for environments in which the audio signal is transmitted by means of sound waves through a medium with interferences or signal degradations. Their embedding and extraction techniques are also not adapted to lightweight devices with limited processing capabilities. There is hence the need of a method and apparatus capable of embedding and extracting watermark data into an audio signal, where the extraction is performed after the audio signal is transmitted through the air as sound waves and captured by a user device, with the subsequent signal degradation.

SUMMARY OF THE INVENTION

The current invention solves the aforementioned problems by disclosing an audio watermark technique in the frequency domain in which the watermark data is codified in a plurality of Fourier transform coefficients. After embedding the watermark data, the resulting watermarked audio is transmitted to a digital to analogic converter, in order for the watermarked audio to be converted to analogic domain for its transmission through sound waves, for example in a radio broadcast. The watermark data is extracted after converting back the watermarked audio to the digital domain at the receiving end. The system takes advantage of the robustness of the watermark codification in the Fourier transform coefficients in order to overcome signal degradation caused while playing, propagating and receiving the audio.

In a first aspect of the present invention, a method for embedding watermark data in an audio signal is disclosed. Watermark data can be any kind of data to be transmitted within the audio signal without greatly altering the perception of said audio signal by a listener. Also, the audio signal can be transmitted by itself, for example in a radio broadcast or in a message played by a particular device, or as a part of audiovisual or multimedia content, such as a television broadcast. According to the disclosed method, a first plurality of Fourier transform coefficients are computed and replaced by a second plurality of Fourier transform coefficients, being the watermark data codified in said second plurality of Fourier transform coefficients. This alteration in the frequency domain results in a watermarked audio that is then transmitted to a digital to analogic converter for its subsequent reproduction and capture. The capture is typically performed by a microphone of a portable user device.

In order to increase the robustness of the embedding method, several preferred options are presented:

A bit codification in which the coefficients used to embed each bit of the watermark data are divided into two groups, typically with the same number of elements. For a first bit value (for example '0'), two different coefficient values are assigned to each group. For a second bit value ('1' in the same example), the coefficient values for each group are interchanged. More preferably, the coefficient values used in the bit codification are proportional to the mean of the first plurality of coefficients of the audio signal being replaced, hence minimizing distortion to the listener and ensuring an appropriate level for the second plurality of coefficients.

Inclusion of a beacon signal to enable the receiving end to identify the beginning of a watermark data transmission. The beacon signal is codified by adding to the unmarked audio signal a frequency peak centered at a predefined frequency. This approach enables quick beacon signal detection, and therefore enables watermark extraction in a scenario in which the beginning of a particular data file is not clearly marked, such as a radio or television broadcast.

Inclusion of a periodic pattern for frequency synchronization. This enables the receiving end to overcome distortions in the audio playback that result in Fourier transform coefficient shifting.

Implementation of redundancy techniques for error correction. By either repeating the transmission of each bit of the watermark or transmitting additional bits to perform error checks, the robustness of the method against interferences and noise is increased.

In a second aspect of the present invention, a method for extracting the embedded watermark data from an audio signal is disclosed. The watermark data is extracted from digitalized audio captured from sound waves instead of from a digital file transmitted to the device performing the extraction. After digitalization of the captured audio, a plurality of Fourier Transform coefficients are computed, typically through Fast Fourier Transform. The watermark data is then decoded from the computed coefficients.

As in the watermark embedding method, several preferred options to increase robustness and efficiency of the watermark extraction method are disclosed:

Decoding the watermark data according to a bit codification in which the Fourier transform coefficients comprising each bit of the watermark data are divided into two groups, typically with the same number of elements. The same coefficient value is assigned to all the coefficients of the same group, being the coefficient values of the two groups disparate. For codifying the two binary values, the coefficient values assigned to each group are interchanged. More preferably, in order to perform a fast decoding of the watermark data, the sum of the first group of coefficients and the sum of the second group of coefficients are compared. Depending on which of the two sums is larger, a '0' or a '1' value is assigned.

Detecting a beacon signal marking the starting point of a watermark data transmission. The beacon signal is detected as a peak in a predefined frequency, typically in the same range as the frequencies used to embed the watermark. Nevertheless, frequencies outside this range can be used in particular embodiments of the invention. In particular, the beacon signal is detected by comparing the values of the Fourier transform coefficients near the predefined frequency, and the values of other Fourier Transform coefficients further away from the predefined frequency.

Periodically searching for a predefined synchronization pattern, both in the Fourier transform coefficients where said synchronization pattern is embedded and in nearby coefficients. If the pattern is detected in a group of coefficients different than the one in which the watermark embedding is expect, a frequency shift is detected and the selection of coefficients for watermark extraction is corrected accordingly.

Applying error correction techniques based on redundancy during the watermark data decoding, typically through voting and error checking techniques.

In a third aspect of the present invention, an apparatus for embedding watermark data in audio signals is disclosed. The watermark embedding apparatus comprises embedding means for computing Fourier transform coefficients of the audio signals and replacing them with coefficients codifying the watermark data. The apparatus also comprises communication means adapted to transmit the watermarked audio to a digital to analogic converter, where the watermarked audio is converted to the analogic domain for its reproduction and subsequent capture.

In a fourth aspect of the present invention, an apparatus for extracting watermark data from a watermarked audio signal is disclosed, where the watermarked audio is a digitalization of an analogic signal. The watermark extracting apparatus comprises extraction means adapted to compute a plurality of Fourier transform coefficients in which watermark data is embedded, and to decode the watermark data from said coefficients.

Preferred options and particular embodiments disclosed for the embedding method can also be applied to the embedding apparatus. Likewise, preferred options and particular embodiments disclosed for the watermark extraction method can be applied to the watermark extraction apparatus.

Finally, in a fifth aspect of the present invention, a computer program is disclosed, comprising computer program code means adapted to perform the steps of the described method when said program is run on a computer, a digital signal processor, a field-programmable gate array, an application-specific integrated circuit, a micro-processor, a micro-controller, or any other form of programmable hardware.

The disclosed audio watermarking methods, apparatus and computer program can operate with audio captured after being played by a different device, providing a robust transmission of the watermark data against distortions in the transmitted audio signal. Their low computational load enable real-time operation in lightweight devices such as cellphones, tablets and other portable electronic devices.

These and other advantages will be apparent with the detailed description of the invention.

BRIEF DESCRIPTION OF THE DRAWINGS

For the purpose of aiding the understanding of the characteristics of the invention, according to a preferred practical embodiment thereof and in order to complement this description, the following figures are attached as an integral part thereof, having an illustrative and non-limiting character.

DETAILED DESCRIPTION OF THE INVENTION

The matters defined in this detailed description are provided to assist in a comprehensive understanding of the invention. Accordingly, those of ordinary skill in the art will recognize that variation changes and modifications of the embodiments described herein can be made without departing from the scope and spirit of the invention.

Note that in this text, the term "comprises" and its derivations (such as "comprising", etc.) should not be understood in an excluding sense, that is, these terms should not be interpreted as excluding the possibility that what is described and defined may include further elements, steps, etc.

Also note that in this text, the term "watermark" and "watermark data" refer to any kind of information transmitted as part of the audio signal without great alteration of the listener's perception of said audio signal. Furthermore, the audio signals in which watermark data is embedded and from which the watermark data is extracted can be transmitted alone or accompanied by any video, image, etc.

Figure 1:
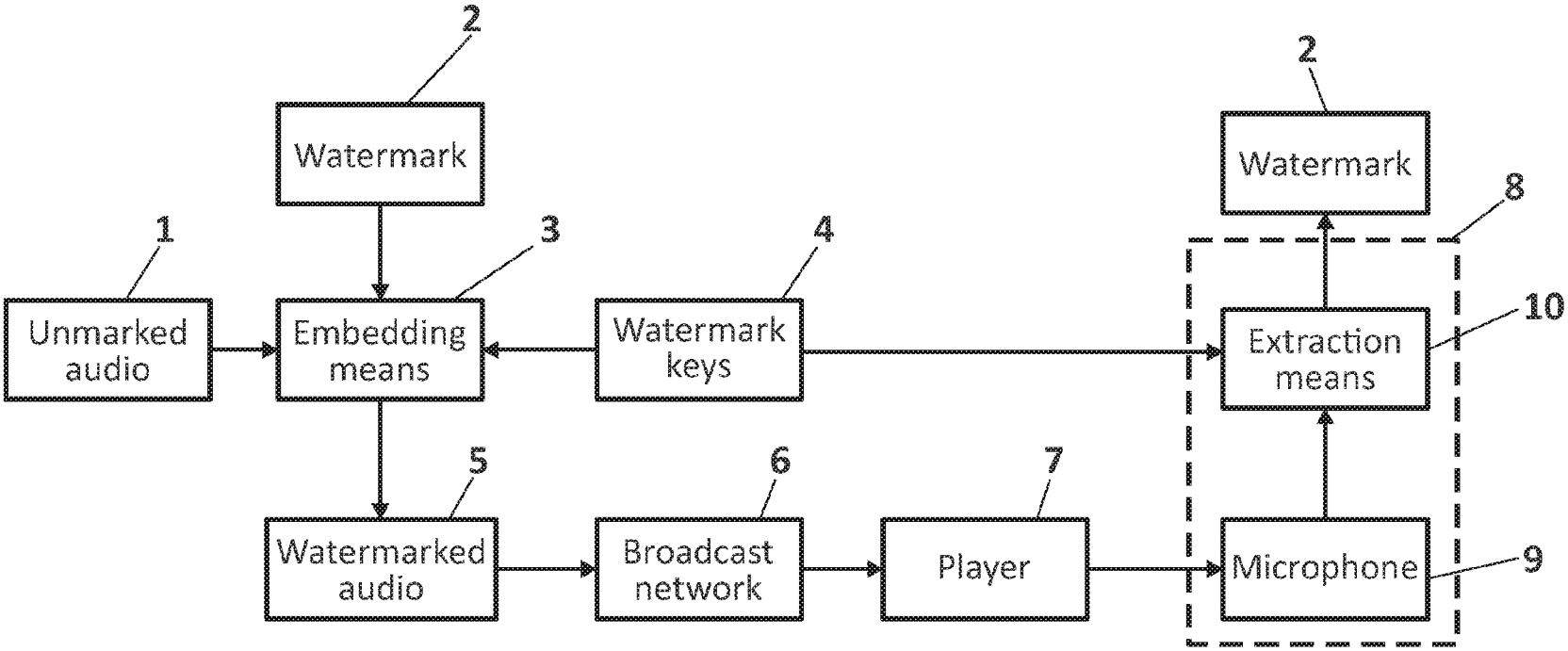
FIG. 1 schematically shows the elements involved in the watermark embedding and extraction process according to a particular embodiment of the invention.

FIG. 1 shows the main elements involved in the watermark embedding and extraction process according to preferred embodiments of the apparatus of the invention, which implement the steps of preferred embodiments of the methods of the invention. The embedding apparatus uses as inputs an unmarked audio signal 1, that is, any digital audio signal or file before it undergoes the embedding process; and a watermark 2, that is, any data susceptible of being embedded in the unmarked audio 1 without greatly distorting a listener's perception of said unmarked audio 1. The watermark 2 is embedded in the unmarked audio 1 by embedding means 3, generating a watermarked audio 5. The embedding means use a watermark key 4 to fix the exact position and strength of the watermark 2. Additionally, encryption and encryption keys can be used to further protect the watermark 2 prior to embedding. The watermark 2 is codified in Fourier transform coefficients of the watermarked audio 5, being the coefficients typically Fast Fourier Transform (FFT) coefficients, which provide a greater robustness against distortions in the time domain. Nevertheless, other transformations to the frequency domain known in the state of the art may be applied in particular embodiments of the invention.

In this particular application scenario, the watermarked audio 5 is transmitted by communication means to a broadcast network 6, such as a radio broadcast network and played in a player 7. Nevertheless, the invention may be applied to any other scenario in which the watermarked audio is later converted to an analogic signal and played as a sound wave. The player 7 can therefore be part of the same device performing the watermark embedding, or part of any external device communicated to the embedding means by any sort of communication connection or network, either digital or analogic. In case of a digital connection, the watermarked audio 5 is converted to the analogic domain by a digital to analogic converter comprised by the player 7. In case of an analogic connection, such as an analogic radio broadcast, said analogic conversion is performed in a digital to analogic converter before transmitting or broadcasting the signal. According to particular embodiments of the embedding apparatus of the invention, the digital to analogic converter can therefore be either part of the embedding apparatus or be part of a different system. Likewise, according to particular embodiments of the embedding method of the invention, the conversion to the analogic domain can be either part of the embedding method or be performed by a different system.

On the receiving end, the transmitted watermarked audio 5 is captured by a microphone 9 of a user device 8, or by any alternative sound acquisition means. After being digitalized by the user device 8, the watermarked audio 5 is analyzed by the extraction means 10, which extract the watermark 2 from the FFT coefficients of the digitalized signal. The same watermark keys 4 need to be at the disposition of the extraction means 10 for the extraction. If encryption was used to codify the watermark 2, the encryption keys will also be required for decryption. According to particular embodiments of the extraction apparatus of the invention, the analogic to digital converter can therefore be either part of the apparatus of the invention, or be part of a different system. Likewise, according to particular embodiments of the extraction method of the invention, the conversion to the digital domain can be either part of the extraction method or be performed by a different system.

A possible application scenario of this invention is to provide supplementary information (such as discount vouchers, gifts or other promotional products) in broadcasted commercials. This can be applied to both radio and television broadcasts. Nevertheless, the disclosed invention can be used in any other application in which hidden data is embedded in an audio signal, such as broadcast monitoring, owner identification, proof of ownership, transaction tracking, content authentication, etc. In a preferred embodiment, the user device 8 is a portable device such as a smart phone, but any other electronic device can be used in specific embodiments of the invention.

Figure 2:
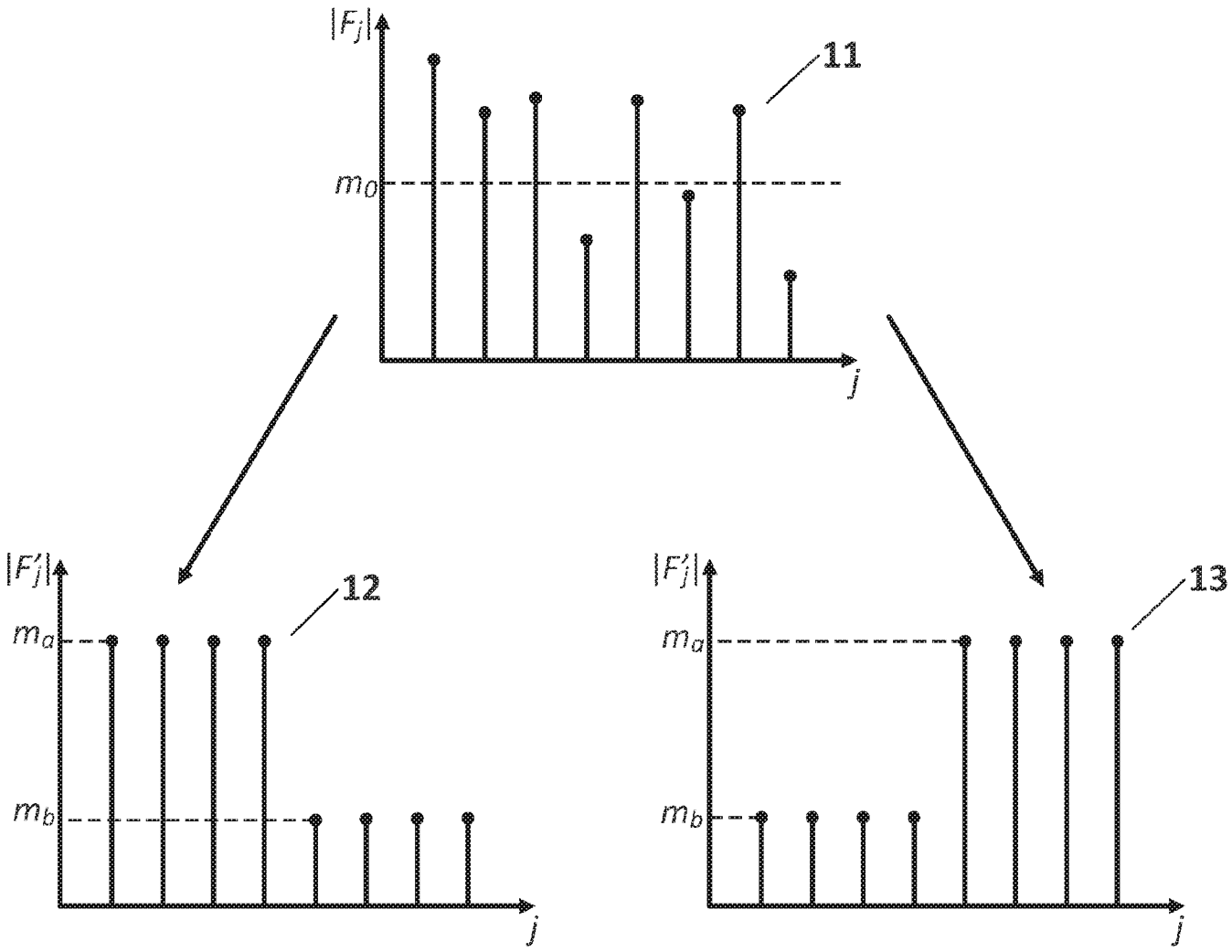
FIG. 2 illustrates the codification of the watermark according to a particular embodiment of the invention.

FIG. 2 presents in greater detail the watermark embedding performed by the embedding means 3. In particular, the watermark embedding starts by computing the FFT of the unmarked audio signal 1, from which a first plurality of Fourier transform coefficients 11 is selected to be replaced by the watermark data 2. For clarity, we will refer to this first plurality of coefficients that have not been altered from the unmarked audio signal 1 as unmarked coefficients 11. The unmarked coefficients 11 are then replaced by a second plurality of coefficients 12, 13 which codify the watermark data 2. We will refer to this second plurality of coefficients as marked coefficients 12, 13.

Each bit of the watermarked data 2 (or a plurality of bits depending on the particular codification used by the embedding system), is embedded in a frame of consecutive FFT coefficients. Therefore, a frequency band is selected for embedding purposes, referred to as the embedding frequency band. The embedding frequency band typically comprises a plurality of frames, each frame of d consecutive FFT coefficients being used for embedding one bit of the watermark 2. The larger d is, the more robust the system becomes, but the less capacity is achieved. Particular embodiments of the invention may codify multiple bits in a single frame.

In particular, FIG. 2 depicts a preferred codification for the watermark data 2, showing the distinction between marked coefficients for a '0' bit 12 and marked coefficients for a '1' bit 13. For each frame of d consecutive FFT coefficients, the mean ($m_0$) of the unmarked coefficients 11 is computed. Then, the d coefficients of the frame are divided into two groups, typically with the same number of elements. For the marked coefficients for a '0' bit 12, a first coefficient value $m_a$ is assigned to all the coefficients of the first group and a second coefficient value $m_b$ is assigned to all the coefficients of the second group. For the marked coefficients for a '1' bit 13, the second value $m_b$ is assigned to the first group and vice versa. This approach maximizes differences between the '0' and '1' bits and enables and efficient decoding at the receiving end.

Furthermore, the first value $m_a$ and second value $m_b$ are proportional to the mean of the unmarked coefficients 11 that are replaced. A first scaling factor α can be applied to regulate the strength of the watermark according to the following equations:

$$m_a=(1+\alpha)m_0$$

$$m_b=(1-\alpha)m_0$$

where the first scaling factor α a is a positive number between 0 and 1. The larger α is, the more robust the system becomes, but the more distortion is introduced in the embedding process.

The marked coefficients for a frame codified with the described codification can be obtained according to the following equation:

$$F_l' = \begin{cases} (1+\alpha)m_0F_j/|F_j|, & \text{if } \mathrm{mod}(j,d) < d/2,\ w=0, \\ (1-\alpha)m_0F_j/|F_j|, & \text{if } \mathrm{mod}(j,d) \geq d/2,\ w=0, \\ (1-\alpha)m_0F_j/|F_j|, & \text{if } \mathrm{mod}(j,d) < d/2,\ w=1, \\ (1+\alpha)m_0F_j/|F_j|, & \text{if } \mathrm{mod}(j,d) \geq d/2,\ w=1. \end{cases}$$

where j is the coefficient index, α is the first scaling factor, d is the number of FFT coefficients of a frame used to codify a single bit of the watermark data, w is the value of the bit being codified, $F_j$ is the value of the j-th unmarked coefficient, $F'_j$ is the value of the j-th marked coefficient, and mod denotes the residual function.

The described watermark data 2 codification, allows a fast an efficient bit decoding by the extraction means 10 of the receiving end. In particular, each bit of the watermark data 2 is decoded by comparing the sum of the coefficients of the first group of coefficients and the sum of the coefficients of the second group of coefficients. In the particular example shown in FIG. 2, if the sum of the first d/2 coefficients of the frame is greater than the sum of the last d/2 coefficients of the frame, a '0' bit is extracted. Otherwise, a '1' bit is extracted. This extraction process is robust and requires a very low computational load, therefore enabling real-time operation in lightweight portable user devices 8.

Figure 3:
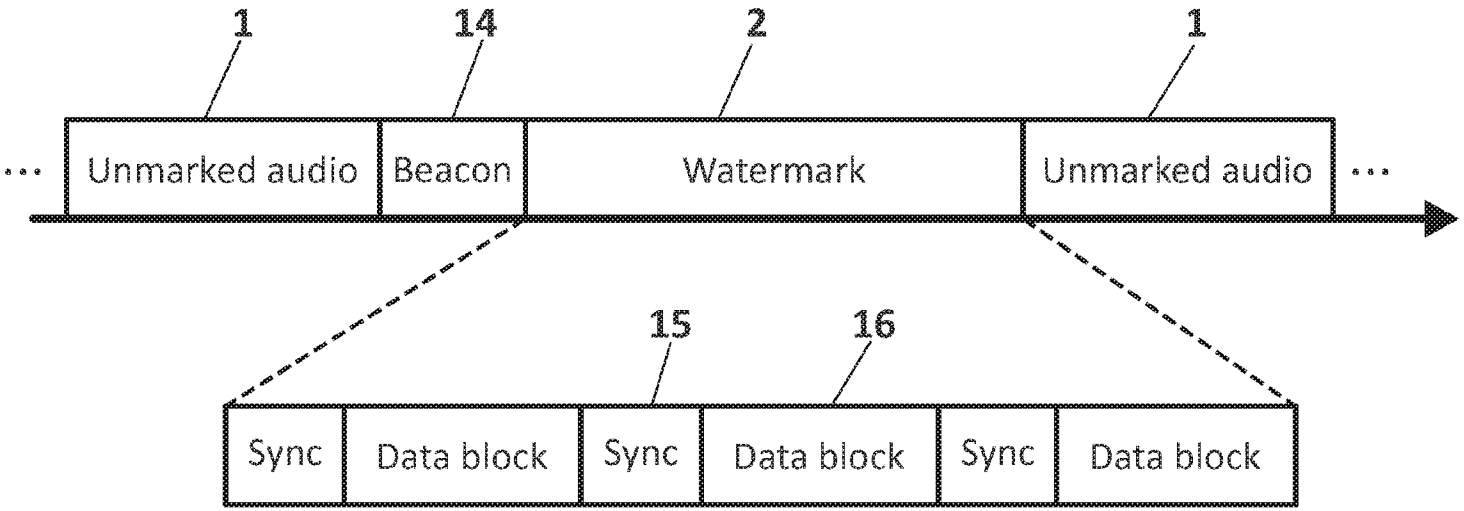
FIG. 3 presents an example of time and frequency synchronization according to particular embodiments of the Invention.

FIG. 3 depicts the synchronization signaling according to particular embodiments of the methods and apparatus of the invention. Since the transmitting end and the receiving end are communicated through sound waves which may suffer distortion, frequency synchronization is implemented to correct possible frequency shifts in the marked FFT coefficients 12, 13. Also, since the start point of a particular audio file is not communicated to the receiving end, time synchronization is also implemented to signal the beginning of the transmission of a watermark 2. Both frequency and time domain synchronization are performed by embedding particular signaling in the frequency domain of the watermarked audio 5. Time synchronization is achieved by preceding each watermark transmission with a beacon signal 14. Frequency synchronization is achieved by periodical synchronization patterns 15.

The beacon signal 14 is implemented as a peak in the FFT spectrum at a predefined frequency $f_{syn}$ for a given duration. The predefined frequency $f_{syn}$ can be in the same frequency range as the FFT coefficients used for embedding the watermark data 2, or it can be in a different frequency range known by both the transmitting and the receiving end. In preferred embodiments, the beacon signal can be implemented in the frequency domain by increasing the FFT coefficient corresponding to the predefined frequency $f_{syn}$. The increase of said FFT coefficient is large enough as to ensure that the increased value is significantly greater than other nearby coefficients. In an equivalent manner, the beacon signal is implemented in the time domain in preferred embodiments by adding to the unmarked audio signal 1 a sinusoidal function oscillating at the predefined frequency $f_{syn}$. According to a particular embodiment, the beacon signal is implemented in the time domain by adding to the unmarked audio signal x(t) the following peak signal $x_{peak}(t)$:

$$x_{peak}(t) = \begin{cases} \beta M \sin(2\pi f_{syn} t), & t_{ini} \leq t \leq t_{end}, \\ 0, & \text{otherwise.} \end{cases}$$

where β is a second scaling factor between 0 and 1, $t_{ini}$ the initial time of the peak, $t_{end}$ is the final time of the peak and M is the maximum value of the unmarked audio signal 1 during the duration of the peak:

$$M = \max_{t_{ini} \leq t_{end}} \{x(t)\},$$

In order to detect the beacon signal 14 in the receiving end, the extraction apparatus detects a peak in the frequency spectrum of the digitalized watermarked audio 5. For this purpose, the FFT of the digitalized signal is computed and the maximum magnitude of a first segment of FFT coefficients centered at the predefined frequency $f_{syn}$ is located. Then, the maximum magnitude of at least a second segment of FFT coefficients which exclude the first segment of FFT coefficients is located. If the maximum magnitude of the first segment is greater than the maximum magnitude of the second segment, a peak is considered to be present. Obviously, a greater number of segments can be used for the peak detection. If the peak is present at least for a predefined duration, a beacon signal 14 is considered to have been received.

Note that in different embodiments within the scope of the invention as claimed, the beacon signal 14 can be implemented as a frequency peak which affects either one or multiple FFT coefficients. Also, in the case of affecting multiple coefficients, the magnitude of the affected coefficients can be constant or varying, as long as their overall magnitude is dearly distinguishable from the unmarked audio signal 1.

Frequency synchronization is performed by means of a periodic transmission and detection of the predefined synchronization pattern 15. The synchronization pattern 15 is a predefined plurality of bits codified in consecutive frames of marked coefficients 12, 13. In the transmitting end, the embedding means 3 codify the synchronization pattern using the same FFT coefficients used to codify the watermark data 2. However, when the watermarked audio 5 is played by the player 7, propagated as sound waves through the air, and captured by the microphone 9, frequency shifts may occur, therefore shifting the marked coefficients 12, 13 that embed the synchronization pattern 15 and the watermark data 2. For this reason, the extraction means search for the synchronization pattern 15 not only in its estimated position, that is, in the marked coefficients 12, 13 where it was embedded by the embedding means 3, but also in a wider range of coefficients. If a best match for the synchronization pattern 15 is found in different coefficients than the ones used for the embedding, the extraction method updates the estimated position with an offset defined by the coefficients associated to the best match, and uses the updated estimated position for extracting the watermark data 2 from the following data block 16. The best match is determined as a plurality of coefficients which, after bit extraction, produce the smallest quadratic error when compared to the synchronization pattern 15.

Robustness of the system against interferences and distortions is increased in particular embodiments of the invention by including redundancy techniques in the embedding process, enabling error correction in the extraction process. In a particular example, each bit of the watermark data 2 is transmitted a plurality of times in different FFT coefficient frames. At the receiving end, each bit is decoded that plurality of times, and the bit value ('0' or '1') that is decoded in a greater number of instances is selected as the decoded bit value. Any other general redundancy and error connection techniques known in the state of the art can also be applied to the present invention. Cryptography techniques can also be implemented in particular embodiments of the invention for additional security.

The described methods and apparatus provide a great capacity, imperceptibility and robustness, which can be adjusted in each particular embodiment depending of the particular requirements of each scenario. Trade-offs between robustness, capacity and imperceptibility are easily controlled by selecting the particular embedding parameters for each scenario, said parameters comprising embedding frequency band, frame size, data block size and scaling parameters.

In particular, capacity is increased when using greater embedding bands, that is, when using a larger number of consecutive FFT coefficient frames in order to codifying a larger number of bits of watermark data 2. This comes at the expense of a greater distortion compared to the unmarked audio signal 1. Capacity is also increased by decreasing the frame size d, that is, the number of FFT coefficients used to codify each bit of the watermark data 2. This comes at the expense of a lesser robustness against distortion in the captured signal. Finally, the capacity is also increased by increasing the size of the data blocks 16 compared to the synchronization pattern 15.

Imperceptibility, that is, similarity perceived by the listener between the unmarked audio 1 and the watermarked audio 5 is also regulated in each particular embodiment. Decreasing the first scaling factor $\alpha$ and/or the second scaling factor $\beta$ increases imperceptibility, at the expense of less robustness in the extraction of the beacon signal 14 and the watermark data 2, respectively. Imperceptibility also increases when reducing frame size d. If less coefficients are used to embed each bit, the distortion introduced by the embedding method decreases. If a narrower embedding band is used, the distortion introduced by the embedding method is also less audible, but the capacity is reduced.

Finally, robustness against interference and playback and capture distortion is increased by using specific embedding bands, greater scaling factors and longer frame sizes. Taking into account that the watermarked audio 5 is typically captured by the microphone 9 of a lightweight device 8, which usually presents a low-pass effect, the chosen embedding band must be selected below the microphone 9 cutoff frequency. The cutoff frequency of mobile phones is usually in the rage 6-10 kHz. Hence, an embedding band below 6 kHz is advised.

The invention claimed is:

1. A method for embedding watermark data in an audio signal comprising:

computing a first plurality of Fourier transform coefficients of the audio signal;

generating a watermarked audio by replacing the first plurality of coefficients with a second plurality of coefficients, the second plurality of coefficients codifying the watermark data following a codification in which, for frames of the first plurality of coefficients, wherein each frame of the frames comprises a first group of coefficients and a second group of coefficients;

a first bit value is codified with the first group of coefficients having a first coefficient value ($m_a$) and the second group of coefficients having a second coefficient value ($m_b$); and a second bit value is codified with the first group of coefficients having the second coefficient value ($m_b$) and the second group of coefficients having the first coefficient value ($m_a$);

transmitting the watermarked audio to a digital to analog signal converter.

2. The method according to claim 1 wherein the first value ($m_a$) and the second value ($m_b$) are proportional to the mean ($m_0$) of the first plurality of coefficients.

3. The method of claim 1 further comprising codifying in the watermarked audio a beacon signal to indicate a starting point of the watermark data in the watermarked audio, said beacon signal being codified as a peak in a predefined frequency of the spectrum of the watermarked audio.

4. The method of claim 1 further comprising periodically codifying in the second plurality of coefficients a synchronization pattern.

5. The method of claim 1 further comprising codifying in the second plurality of coefficients the watermark data with redundancy techniques.

6. A method for extracting watermark data from a watermarked audio, the watermark data being embedded in a plurality of modified Fourier transform coefficients of the watermarked audio, characterized in that the watermarked audio is a digitalized analog signal, and in that the method comprises:

computing a plurality of modified Fourier transform coefficients of the digitalized watermark audio;

decoding the watermark data from the plurality of modified Fourier transform coefficients according to a codification in which, for frames of the plurality of modified Fourier transform coefficients, wherein each frame of the frames comprises a first group of coefficients and a second group of coefficients:

a first bit value is codified with the first group of coefficients having a first coefficient value ($m_a$) and the second group of coefficients having a second coefficient value ($m_b$); and a second bit value is codified with the first group of coefficients having the second coefficient value ($m_b$) and the second group of coefficients having the first coefficient value ($m_a$).

7. The method according to claim 6 wherein the watermark data is decoded from the plurality of modified coefficients of the converted digital signal by comparing a sum of the first group of coefficients and a sum of the second group of coefficients.

8. The method according to claim 6 further comprising detecting in the plurality of modified coefficients a beacon signal which indicates a starting point of the watermark data in the watermarked audio, said beacon signal being detected by comparing a first segment of Fourier transform coefficients centered at a predefined frequency, and at least a second segment of Fourier transform coefficients further from the predefined frequency than the first segment of coefficients.

9. The method according to claim 6 further comprising periodically locating a synchronization pattern in the modified Fourier transform coefficients of the watermarked signal, and offsetting the coefficients used for watermark data extraction according to the position of the synchronization pattern.

10. The method according to claim 6 further comprising decoding the watermark data from the plurality of modified coefficients according to redundancy techniques implemented in said modified coefficients.

11. Apparatus for embedding watermark data in an audio signal, the apparatus comprising one or more processors coupled to one or more memories, the one or more memories comprising computer-executable instructions that, when executed on at least one of the one or more processors, cause the apparatus to perform operations for:

computing a first plurality of Fourier transform coefficients of the audio signal, and generating a watermarked audio by replacing the first plurality of coefficients with a second plurality of coefficients, the second plurality of coefficients codifying the watermark following a codification in which, for frames of the first plurality of Fourier transform coefficients, wherein each frame of the frames comprises a first group of coefficients and a second group of coefficients:

a first bit value is codified with the first group of coefficients having a first coefficient value ($m_a$) and the second group of coefficients having a second coefficient value ($m_b$); and a second bit value is codified with the first group of coefficients having the second coefficient value ($m_b$) and the second group of coefficients having the first coefficient value ($m_a$);

transmitting the watermarked audio to a digital to analog converter.

12. Apparatus, comprising one or more processors coupled to one or more memories, for extracting watermark data from a watermarked audio, the watermark data being embedded in a plurality of modified Fourier transform coefficients of the watermarked audio, characterized in that the watermarked audio is a digitalization of an analog signal and in that the one or more memories comprise computer-executable instructions that, when executed on at least one of the one or more processors, cause the apparatus to perform operations for computing the plurality of modified coefficients of the converted digital signal and for decoding the watermark data from the plurality of modified coefficients according to a codification in which, for a plurality of frames of the plurality of modified coefficients, wherein each frame of the plurality of frames comprises a first group of coefficients and a second group of coefficients:

a first bit value is codified with the first group of coefficients having a first coefficient value ($m_a$) and the second group of coefficients having a second coefficient value ($m_b$); and a second bit value is codified with the first group of coefficients having the second coefficient value ($m_b$) and the second group of coefficients having the first coefficient value ($m_a$).

13. The apparatus of claim 12 wherein the watermark data is decoded from the plurality of modified coefficients of the converted digital signal by comparing a sum of the first group of coefficients and a sum of the second group of coefficients.

14. The apparatus of claim 12 wherein the one or more memories further comprise computer-executable instructions that, when executed on the at least one of the one or more processors, cause the apparatus to perform operations for detecting in the plurality of modified coefficients a beacon signal which indicates a starting point of the watermark data in the watermarked audio, said beacon signal being detected by comparing a first segment of Fourier transform coefficients centered at a predefined frequency, and at least a second segment of Fourier transform coefficients further from the predefined frequency than the first segment of coefficients.

15. The apparatus of claim 12 wherein the one or more memories further comprise computer-executable instructions that, when executed on the at least one of the one or more processors, cause the apparatus to perform operations for decoding the watermark data from the plurality of modified coefficients according to redundancy techniques implemented in said modified coefficients.

16. One or more non-transitory computer-readable media comprising computer-executable instructions that when executed cause a computing system to perform processing to embed watermark data in an audio signal, the processing comprising:

computing a first plurality of Fourier transform coefficients of the audio signal;

generating a watermarked audio by replacing the first plurality of coefficients with a second plurality of coefficients, the second plurality of coefficients codifying the watermark data following a codification in which, for a plurality of frames of the first plurality of coefficients, wherein each frame of the plurality of frames comprises a first group of coefficients and a second group of coefficients;

a first bit value is codified with the first group of coefficients having a first coefficient value ($m_a$) and the second group of coefficients having a second coefficient value ($m_b$);

a second bit value is codified with the first group of coefficients having the second coefficient value ($m_b$) and the second group of coefficients having the first coefficient value ($m_a$);

transmitting the watermarked audio to a digital to analog signal converter.

17. The one or more non-transitory computer-readable media of claim 16 wherein the first value ($m_a$) and the second value ($m_b$) are proportional to the mean ($m_0$) of the first plurality of coefficients.

18. The one or more non-transitory computer-readable media of claim 16 wherein the processing further comprises codifying in the watermarked audio a beacon signal to indicate a starting point of the watermark data in the watermarked audio, said beacon signal being codified as a peak in a predefined frequency of the spectrum of the watermarked audio.

19. The one or more non-transitory computer-readable media of claim 16 wherein the processing further comprises periodically codifying in the second plurality of coefficients a synchronization pattern.

20. The one or more non-transitory computer-readable media of claim 16, wherein the first and second groups of coefficients are defined in the same way for the plurality of frames.

* * * * *